United States Patent [19]

Nunemacher

[11] 4,149,687

[45] Apr. 17, 1979

[54] BABY POUCH

[76] Inventor: Rosemary A. Nunemacher, 734 W. 5th Ave., Mesa, Ark. 85202

[21] Appl. No.: 822,744

[22] Filed: Aug. 8, 1977

Related U.S. Application Data

[63] Continuation-in-part of Ser. No. 751,664, Dec. 17, 1976, abandoned.

[51] Int. Cl.[2] ..... A47D 13/02

[52] U.S. Cl. ..... 224/159

[58] Field of Search ..... 224/6, 5 BC, 5 Q, 5 MA, 224/5 MC, 25 A, 8 R; 297/385, 390, 391, 392

[56] References Cited

U.S. PATENT DOCUMENTS

| | | | |
|---|---|---|---|
| 2,690,864 | 10/1954 | Dautermann et al. | 224/6 |
| 3,780,919 | 12/1973 | Hansson | 224/6 |
| 3,871,562 | 3/1975 | Grenier | 224/6 |
| 4,009,808 | 3/1977 | Sharp | 224/6 |
| 4,037,764 | 7/1977 | Almosnino | 224/6 |

FOREIGN PATENT DOCUMENTS

| | | | |
|---|---|---|---|
| 618269 | 2/1949 | United Kingdom | 224/6 |

*Primary Examiner*—Duane A. Reger
*Assistant Examiner*—Jerold M. Forsberg
*Attorney, Agent, or Firm*—Herbert E. Haynes, Jr.

[57] ABSTRACT

A baby pouch which supports an infant in a position in front of a person wearing the pouch with the latter being supported from the neck of the person. The pouch consists essentially of a fabric back support and a front panel integrally joined to the back support by a neck-like crotch portion. Lateral extensions are integral with the front panel and have end portions formed with detachable fastening elements which are connected after the extensions are wrapped around the back support with the baby positioned on its front. A head rest extends across the upper edge of the back support. A pair of straps are adjustable as to length and each of them has one end secured to the upper end of the back support at one side with the other end having means for adjusting the length of the strap and detachably securing it to the front panel. A neck strap of fixed length has a metallic loop secured to each end with each loop receiving one of the straps of adjustable length and a neck pad is slidably mounted on the neck strap. A pair of adjustable back straps depend from the neck pad so as to extend down the back and around the waist of the person and are detachably coupled to opposite sides of the pouch.

12 Claims, 7 Drawing Figures

BABY POUCH

CROSS REFERENCE TO RELATED APPLICATIONS

This application is a continuation-in-part of copending prior application Ser. No. 751,664, filed by the same inventor on Dec. 17, 1976, which is now abandoned.

BACKGROUND OF THE INVENTION

The present invention relates to those devices which are intended to support an infant of tender years from the person of an attendant such as a parent or a nurse and is concerned primarily with a baby pouch which supports an infant from the back of the neck of the attendant and in front of the person of the attendant.

At the present time those persons charged with the care of infants ranging in age from six to eight weeks to the time they are able to walk are often desirous of carrying the infant about while engaged in other operations. Among such operations are camping, hiking, picnicing, shopping, and housework and it is desirable that the attending person have the use of both arms and hands while so engaged.

Over the years much effort has been directed to providing a carrier for the infant which is supported from the body of the attendant. Such carriers have taken many forms. Perhaps the most widely used carrier is one of the so-called knapsack types which supports the infant from the shoulders of the attendant and positions the baby on the back of the attendant. Back carriers of this type present many disadvantages among which it is noted that after the carrier is positioned on the shoulders it is difficult to get the child into the carrier and remove him therefrom. Moreover, if the child gets restless, needs feeding, is wet, or must be checked for wetness, the attendant must completely remove the child from the carrier which leaves the carrier on the back of the attendant.

Carriers of the sling type have also been provided. Carriers of this kind are usually supported from a shoulder of an attendant. They have the notable disadvantage of being susceptible of use for only very small babies and does not adjust to a baby's growth. Moreover, the hands of the attendant must be used to cradle a child while in the sling.

Another type of carrier for babies which is meeting with some use is of the seat type which consists essentially of a seat which is rigid to an appreciable degree and which receives the baby. A device of this type has some advantages because the baby is occupied while the attendant is engaged in other activities; however, the attendant must disencumber his arms with anything with which they might be engaged to set the seat down or pick it up and both hands are required for this operation. It is impractical, if not impossible, to carry packages as one is engaged in shopping for any length of time and carry the seat with a baby therein.

The known art contains examples of baby carriers which positions the infant in front of the person of the attendant and supports the infant from the neck of the attendant. However, such known devices have met with little if any acceptance by the public due to the fact that they include rigid frames. Such rigid frames are awkward to store, handle, wash, and carry. They decrease the comfort with which a baby is accommodated and also the comfort of the attendant wearing one of these devices.

The present invention is founded on the belief that there is a need for a baby pouch which will support an infant in front of the person and from the neck of an attendant and all of the elements of which are flexible such as being of a fabric with the exception of buckles, fasteners, and similar devices.

OBJECTS OF THE INVENTION

With the foregoing conditions in mind the present invention has in view the following objectives:

(1) To provide a baby pouch which supports an infant from the neck of an attendant and in front of the person of the attendant.

(2) To provide, a baby pouch of the type noted, which is completely of fabric with the exception of buckles, length adjusters, and fastening elements.

(3) To provide, in a baby pouch of the character aforesaid, a so-called receiving unit consisting of a fabric back support, a crotch portion integral with and extending from the lower end of the back support, a front panel integral with the crotch portion and lateral extensions on the front panel in the form of bands which are integral therewith and extending from the opposite sides of the front panel.

(4) To provide, in a baby pouch of the kind described, detachable fastening elements on the ends of the bands for securing them together after they have been wrapped around the neck support with an infant occupying the receiving unit.

(5) To provide, in a baby pouch of the type noted, a headrest which extends across the top of the back support.

(6) To provide, in a baby pouch of the character aforesaid, a pair of adjustable straps each having one end anchored to the back support at the upper edge and at one side thereof together with means for adjusting the length of each strap at its other end and an element of a detachable connection which cooperates with a complemental element on the front panel.

(7) To provide, in a baby pouch of the kind described, a neck strap of fixed length having a metallic loop secured to each end and through which loops the straps of adjustable length pass.

(8) To provide, in a baby pouch of the type noted, a tubular neck pad which slidably receives the neck strap.

(9) To provide, in a baby pouch of the above described character a pair of longitudinally adjustable back straps depending from the neck pad so as to extend down the back and oppositely around the waist of the attendant for detachable connection to the opposite sides of the receiving unit.

Various other more detailed objects and advantages of the invention, such as arise in connection with carrying out the above ideas in a practical embodiment, will, in part, become apparent and, in part, be hereinafter stated as the description of the invention proceeds.

SUMMARY OF THE INVENTION

The foregoing objects are achieved by providing a baby pouch which includes as a characteristic and essential element, a one piece receiving unit comprising a back support of generally rectangular shape having a necklike crotch portion at one end to which a front panel is joined. Extending from opposite sides from the front panel are lateral extensions in the form of bands having complemental elements of a detachable connection such as buttons and buttonholes adjacent to their free ends.

A headrest in the form of a fabric band extends across the upper edge of the back support. Connected to the back support at the upper edge and sides thereof are a pair of straps which are adjustable in length. Each of these straps at the end remote from its anchorage to the back support is provided with a buckle or similar device for adjusting the effective length of the strap. Secured to this buckle is a clasp which provides a keyhole opening. Each of these clasps cooperates with a headed fastener mounted on the edge of the front panel remote from the crotch portion.

A neck strap of fixed length has an elongated metallic loop secured to each of its free ends, with one of the adjustable straps passing through each of these loops. A tubular neck pad is slidably mounted onto the neck strap.

A pair of longitudinally adjustable back straps are dependingly affixed to the neck and have suitable hook elements on the free ends thereof for detachable connection with suitable loop connectors provided on the lateral bands of the receiving unit.

The baby pouch of the present invention is applied to an infant as follows:

The pouch is laid out in an open position on an appropriate supporting surface such as a bed, table, carpet, or the like. The baby's head and/or shoulders is placed on the headrest with the baby's torso resting on the back support. The crotch portion is now brought up between the baby's legs and the front panel positioned in front of the baby's torso. The straps which are adjustable in length after having been adjusted to the proper extent are folded down over the metallic loops and the clasps on the end thereof secured to the metal stays on the front of the front panel.

The baby as so positioned in the receiving unit is turned over whereupon the ends of the lateral extensions or bands are secured together and to the proper extent by the selective use of the buttons and buttonholes. The baby is now turned over on its back or placed in a sitting position whereupon the attendant leans forward, slides her neck through the neckband and with both hands adjusts the neck pad at the back of the neck making the adjustment necessary for comfort. The back straps are then wrapped in opposite directions around the attendant's waist from back to front and connected to the loop connectors provided on the front face of the lateral bands.

For a full and more complete understanding of the invention, reference may be had to the following description and accompanying drawings wherein.

DESCRIPTION OF THE PREFERRED EMBODIMENTS

Figure 3:
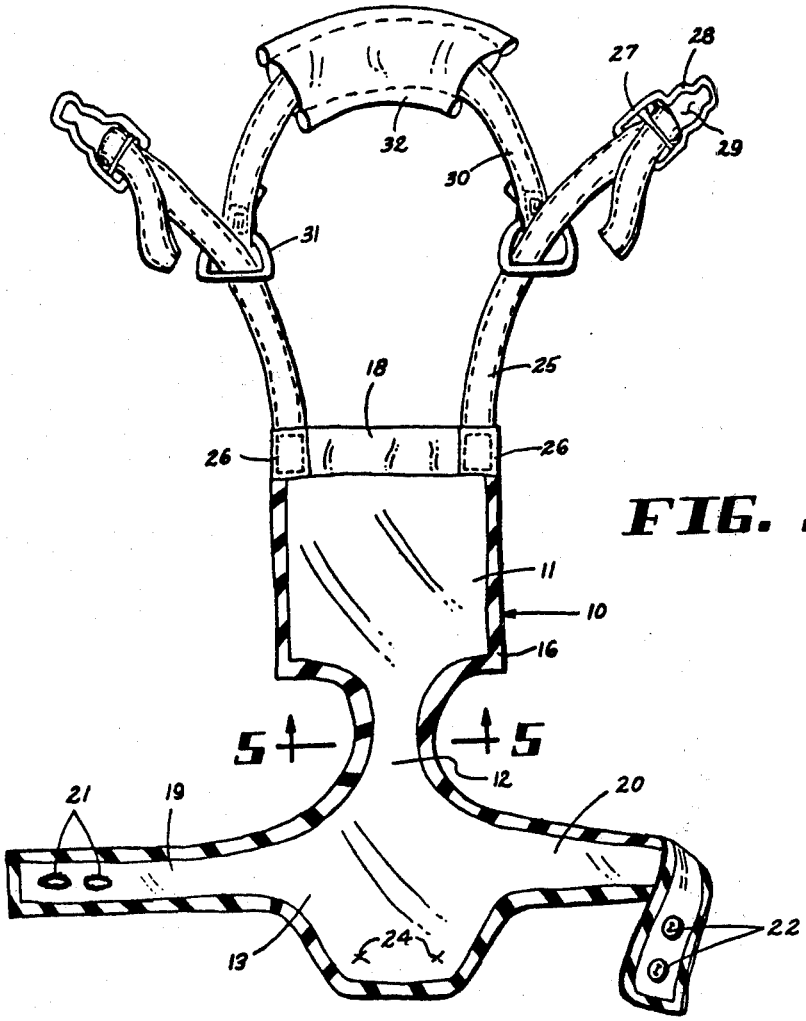
FIG. 3 is a top plan view of the baby pouch as placed flat in the position which it assumes immediately prior to placing a baby thereon.
Figure 5:
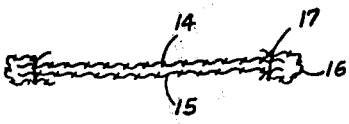
FIG. 5 is a detailed transverse section through the crotch portion being taken about on the plane of the line 5—5 of FIG. 4.

Referring now to the drawings wherein like reference characters denote corresponding parts and first more particularly to FIG. 3, the baby pouch of this invention is shown as including a baby receiving unit referred to its entirety as 10 and comprises a back support 11, a crotch portion 12, and a front panel 13, all of which are of fabric and integrally joined together. While it may be possible and entirely practical to form this unit from a single ply of fabric, in a preferred embodiment two layers are preferred as shown in FIG. 5. Thus, it has an inner layer 14 which preferably is of denim and an outer layer 15 which may be of an appropriate color according to the desired decorative effects. It will be noted that an edging 16 is applied to the peripheries of the elements 11, 12, and 13 and secured thereto by stitching 17.

Back panel 11 is generally rectangular in shape thereby presenting a straight upper edge to which a headrest 18 is attached. While this element 18 is identified as a headrest it should be understood that it may also be engaged by the shoulders of an infant after he is grown. Further, the headrest 18 may be an integral part of the back support 11, and if thus configured may be covered with a decorative material preferrably cut on the bias.

Extending from opposite sides of front panel 13 are lateral extensions or bands 19 and 20 which are integral with the front panel. End portions of extensions 19 and 20 are provided with elements of a detachable connection and in the illustrated embodiment these take the form of a pair of buttonholes 21 on extension 19 and a pair of buttons 22 on extension 20. This arrangement also provides some adjustability in the effective length of the infant encirculing band provided by front panel 13 and extensions 19 and 20.

Figure 2:
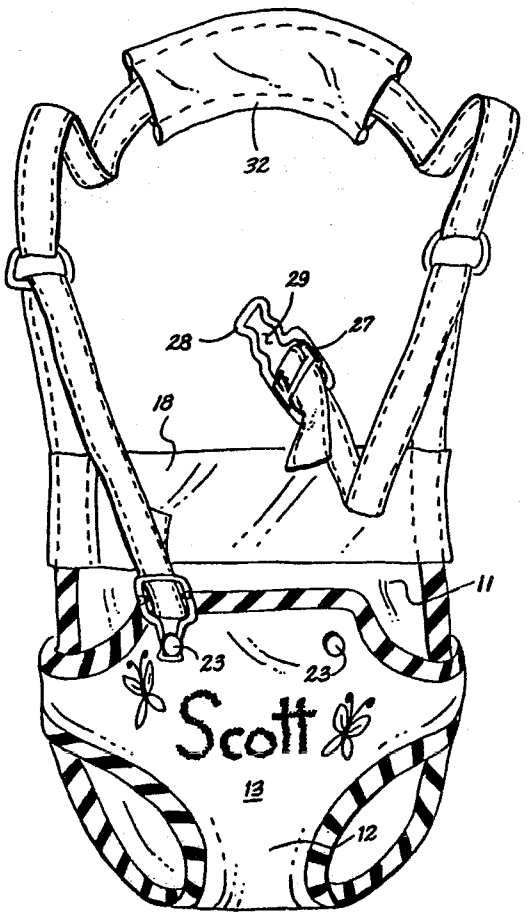
FIG. 2 is a view in front elevation of the baby pouch in the position it assumes when occupied by an infant, but with the infant omitted.

Referring for the moment more particularly to FIG. 2, a pair of metallic stays or headed fasteners provide anchors 23 on the front or exposed face of panel 13 when the pouch is occupied by an infant. The backing for these stays 23 are shown at 24 in FIG. 3.

A pair of fabric straps are designated 25. One end of such strap 25 is secured to the upper end of the back support 11 and at one side thereof as identified at 26. The straps 25 are adjustable as to their effective lengths. Secured to each strap 25 adjacent to its free end is a buckle like device 27 through which the strap is passed to adjust its effective length. Secured to or forming a part of each buckle like device 27 is a clasp 28 which presents what is in effect a keyhole slot 29. It is evident that an end of a strap 25 may be attached to the front panel 13 by passing the larger portion of the keyhole slot 29 over the head of stay 23 and then exerting a pull on the strap to bring the narrow portion of the keyhole slot beneath the head of the stay.

A fabric neck strap 30 is of fixed length and has an elongated metallic loop 31 secured to each end. Each strap 25 passes through one of these loops 31, after being folded back on itself, and is attached to the front panel 13 in the manner above described. A fabric neck pad 32 is of a tubular construction and slidably receives neck strap 30, thus providing relative adjustment between these elements.

OPERATION

Figure 1:
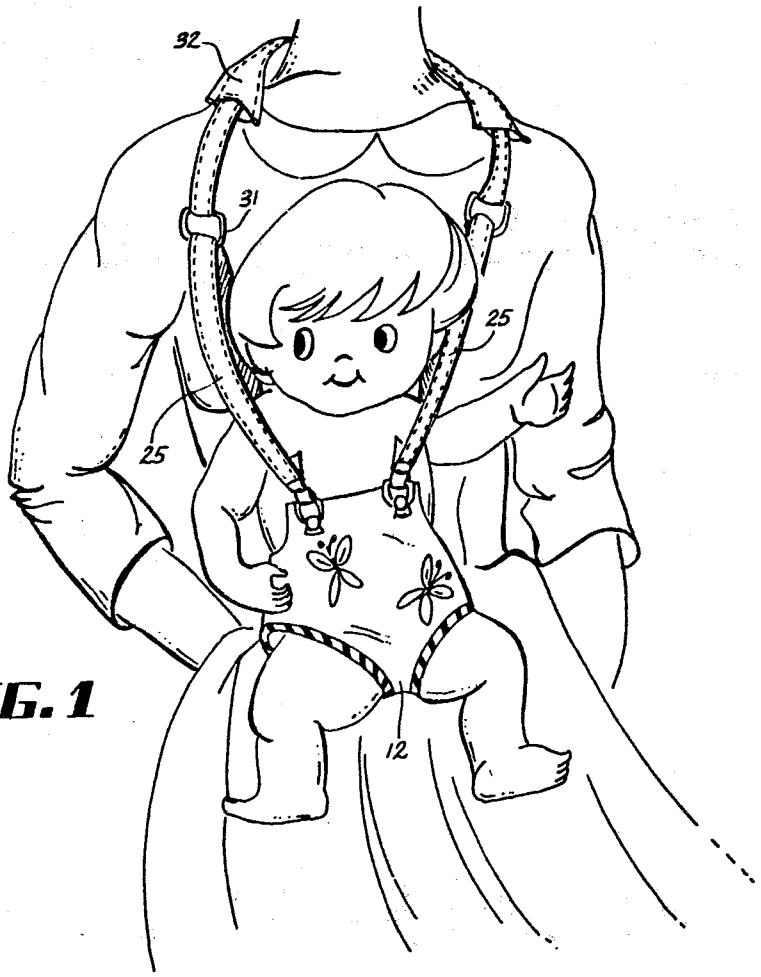
FIG. 1 is a front view of a portion of an attendant supporting a baby from the neck and in front of the person in accordance with the precepts of this invention.

While the manner in which the subject baby pouch is applied to an infant and just how it functions is believed to be obvious from the illustrations of the drawings and description of parts set forth above is briefly described as follows:

The straps 25 are passed through loops 31, the buckle like devices 27 are applied to the straps and the latter adjusted to achieve the desired length of these straps. The entire baby pouch is then spread out in a flat condition on an appropriate supporting surface as illustrated in FIG. 3. The infant is then laid on his back on the receiving unit 10 in a position in which either his head or shoulders engage the headrest 18. The crotch portion 12 is then folded in position between the infant's legs as illustrated in FIG. 1 which brings the front panel 13 into a position covering the front of the infant's torso. Straps 25 are then folded down over the baby's shoulders and clasps 28 applied to the anchors or stays 23 in a well known manner. The last portion of these operations will be the exerting of a pull on the straps to bring the narrow portions of the keyhold slots 29 beneath the heads of the anchors or stays 23.

Figure 4:
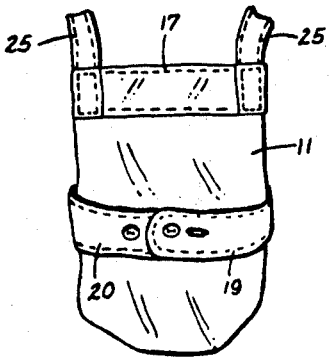
FIG. 4 is a fragmentary rear elevation illustrating the receiving unit with the lateral extensions on the front panel secured together at the rear of the back support.

The baby in the pouch is now turned over so that his posterior side and back support 11 are in the uppermost position. Now the extensions 19 and 20 are then wrapped about the rear support 11 in the position illustrated in FIG. 4 and the proper buttonhole or buttonholes 21 applied to a button or buttons 22 to provide the desired encompassing effect of the front panel 13 and extensions 19 and 20 as a unit.

The attendant, who ordinarily is a parent and usually the mother, leans forward slightly and places the neck pad 32 against the back of her neck. She then straightens up into the position of FIG. 1.

Figure 6:
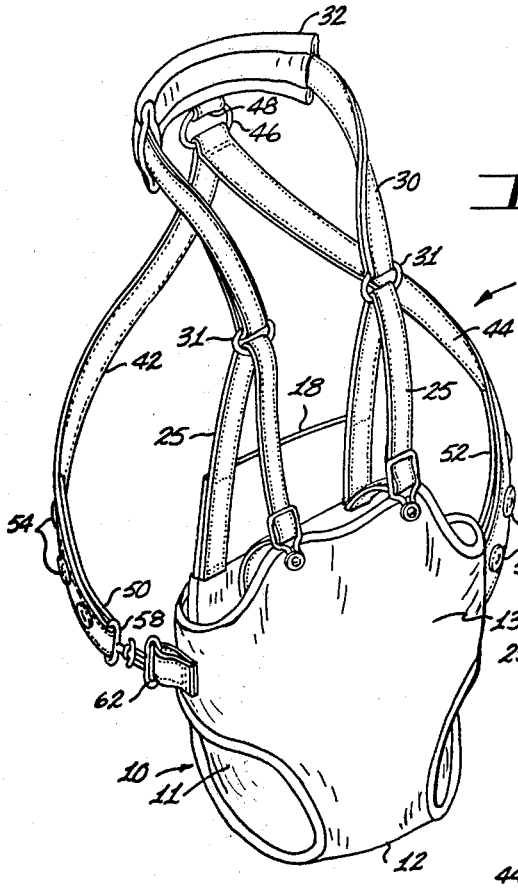
FIG. 6 is a perspective view of a modified form of the baby pouch of the present invention in the position it assumes when affixed to an attendant and having a baby positioned therein, with the attendant and baby being omitted for clarity, with this modification including back straps.
Figure 7:
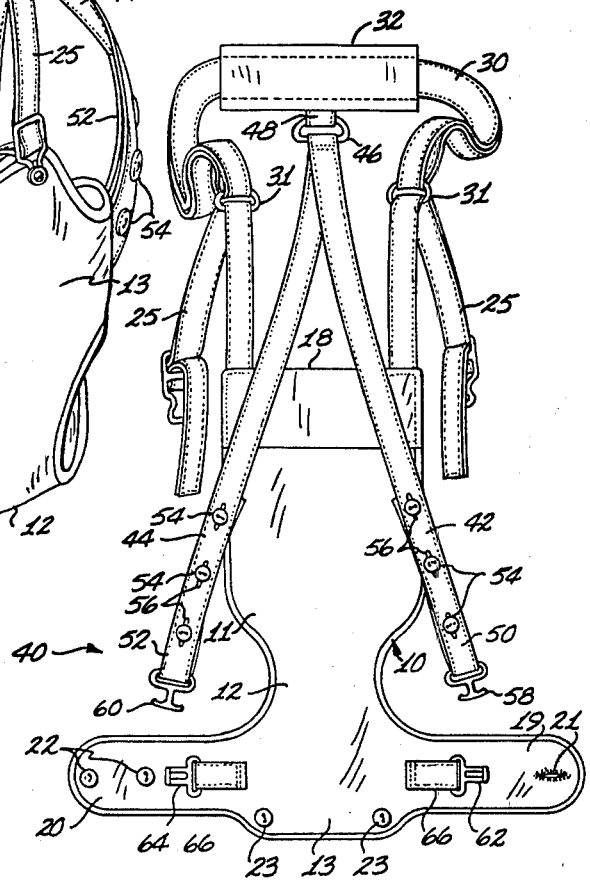
FIG. 7 is a bottom plan view of the baby pouch of the present invention showing the modification of FIG. 6, with this view being similar to FIG. 3 but inverted to show the details of the back straps and connecting elements thereof.

Reference is now made to FIGS. 6 and 7 wherein a modified form of the baby pouch of the present invention is indicated in its entirety by the reference numeral 40. The pouch 40 is similar to the hereinbefore described pouch and is thus seen to include all the previously described portions and elements.

In addition to those described portions and elements, the modified baby pouch 40 further includes a pair of back straps 42 and 44 which are suitably secured to a single ring 46 that is carried in a fabric loop 48 affixed to the neck pad 32. The ring 46 and loop 48 are positioned so that the back straps 42 and 44 depend from the neck pad 32 toward the receiving unit 10 when the baby pouch 40 is occupied by a baby and mounted on an attendant, as will hereinafter be described in detail.

Each of the depending back straps 42 and 44 are adjustable as to the effective lengths thereof, and such adjustments are accomplished by folding the free ends of those straps back on themselves to form loops 50 and 52 thereon which are secured in those looped configurations by suitable complemental fastening elements such as the buttons 54 and buttonholes 56 shown.

Appropriate metallic hook elements 58 and 60 are carried in the loops 50 and 52 of the respective back straps 42 and 44, for demountable connection with suitable metallic loop couplers 62 and 64 mounted on the receiving unit 10.

As shown best in FIG. 7, the outwardly disposed face of the laterally extending bands 19 and 20 each have a fabric loop 66 affixed thereto, such as by stitching, with those loops 66 each carrying one of the loop coupler elements 62 and 64.

The baby pouch 40 is applied to an infant in the same manner as previously described, and is worn by the attendant in a similar manner except that the back straps 42 and 44 are added thereto. With the pouch 40 depending from the neck so as to be positioned in front of the attendant, the back straps 42 and 44 depend from the neck pad 32 down the back of the attendant and are wrapped oppositely from back to front around the attendant's waist. The back straps are then coupled to opposite sides of the receiving unit 11 by means of the complemental elements; namely, the hooks 58, 60 and the loop elements 62,64. That disposition and connecting of the back straps is shown in FIG. 6 in which the attendant and baby have been omitted for clarity.

The desirability of employing the back straps 42 and 44 will be appreciated upon consideration of the load placed upon the attendant's neck especially when the baby advances in size and weight. The back straps will relieve some of the load placed upon the attendant's neck by transferring some of that load to the upper shoulders and back of the attendant. Further, the back straps provide a safety feature in that the baby cannot swing penduously from the neck of a bent over attendant.

The subject baby pouches have the following advantages: they are convenient and neither being gaudy nor complicated, may be worn with comfort by both the baby and attendant. They are adjustable to the needs of both the baby and attendant and adjusts to the growth of the infant. Another advantage which does not enter into the mechanical functioning of the pouch is that they are neat, trim and offer a desirable appearance whereby they are adapted to be ornamented by color, design and style. Thus, in accordance with conventional practice, they may be either pink or blue to designate the sex of the infant.

Being of fabric, the pouches are completely washable by present day washing machines. Further advantages which are particularly tied into the baby pouches is the fact that they are valuable as a teaching tool for children between the ages of six to eight weeks to walking age. They increase the child's alertness and awareness of surroundings. Moreover, the child is up and around using his various senses such as sight and is maintained close to the attendant. They are also helpful in developing the baby's posture as they do not permit slouching. The weight of the baby maintains the back straight and keeps the shoulders and head erect. The baby can be readily checked for wetness while in the pouch or if the baby gets restless or tired, the straps in front can be unclasped and the baby turned to the shoulder of the parent or put in a sitting position in the lap without having to remove the baby from the pouch or the pouch from the attendant. One of the most important and final advantages is that the baby can be fed or nursed while in the pouch.

Some of the advantages which will inure to the benefit of the attendant is that the pouches are entirely adapted for use while camping, hiking, biking, shopping, and doing housework. Moreover, it is good for the posture of the attendant as it helps keep the shoulders back and the tummy in. The pouch is adjustable to suit the needs and comfort of the attendant.

Moreover, no adjustments are made in back of the attendant's neck and finally, the baby is always in full view of the watchful eye of the attendant.

While the preferred embodiments of the invention are hereinbefore disclosed, it is to be clearly understood that the invention is not limited to the exact construction, materials, and designs illustrated and described because various modifications may be provided in putting the invention into practice.

What I claim is:

1. A baby pouch for carrying a baby in front of a bearer comprising:

(a) an infant receiving unit including a fabric back support positionable adjacent the baby's back, a crotch portion extending integrally from the lower end of said back support and positionable between the baby's legs, a front panel extending integrally from said crotch portion and positionable adjacent the baby's abdomen, said front panel having a free edge, lateral extensions integral with and extending from opposite sides of said front panel, said lateral extensions for wrapped around encirclement of the baby and said back support when the baby is received in said receiving unit;

(b) complimental elements of a detachable connection on end portions of said lateral extensions for overlapped interconnection of the end portions of said lateral extensions when wrapped around the baby and said back support;

(c) a pair of strap anchors mounted on said front panel adjacent the free edge thereof;

(d) a pair of fabric straps including means for adjusting the effective lengths thereof, one end of each of said straps being secured to said back support at the upper edge and adjacent one side of said back support;

(e) a clasp on the other end of each of said straps, each of said clasps demountably connectable with a different one of said strap anchors to form said pair of fabric straps into looped configurations which pass forwardly over and above the baby's shoulders when the baby is in said receiving unit;

(f) a neck strap having a pair of metallic loops secured to the ends thereof with each of said loops having a different one of said pair of fabric straps slidably passing therethrough so that said neck strap is formed into a looped configuration that is positionable about the neck of the bearer; and (g) a neck pad mounted on said neck strap.

2. A baby pouch as claimed in claim 1 wherein the elements of a detachable connection include means for adjusting the effective length of said lateral extensions when connected by said elements.

3. A baby pouch as claimed in claim 1 wherein the elements of a detachable connection include at least one buttonhole on one of said lateral extensions and at least a pair of buttons on the other lateral extension.

4. A baby pouch as claimed in claim 1 wherein said strap anchors on said front panel take the form of headed metallic stays and said clasps on said straps of adjustable length present keyhole slots which cooperate with the headed stays.

5. A baby pouch as claimed in claim 1 and further comprising a headrest extending across the upper edge of said back support.

6. A baby pouch as claimed in claim 1 wherein said neck pad is of tubular configuration and is slidably positionable on said neck strap.

7. A baby pouch as claimed in claim 1 in which the receiving unit is of a two ply fabric together with edgings secured to all of the peripheral edges of the unit with the exception of the upper edge of the back support.

8. A baby pouch as claimed in claim 1 in which the loops on the neck strap are of an elongated shape presenting lower portions which are substantially straight and over which said fabric straps are folded when the pouch is applied to an infant.

9. A baby pouch as claimed in claim 1 and further comprising:

(a) a pair of back straps of adjustable length mounted on said neck pad so as to depend therefrom; and (b) complemental elements of a detachable connection on the depending ends of said pair of back straps and on said lateral extensions for demountably connecting said back straps to opposite sides of said receiving unit when said lateral extensions are wrapped around said back support.

10. A baby pouch as claimed in claim 9 wherein said pair of back straps are mounted on said neck pad by connection thereof to a metallic ring carried in a fabric loop fixedly attached to said neck pad.

11. A baby pouch as claimed in claim 9 wherein each of said back straps has means thereon for detachably securing the free end thereof in variously folded back relationships for adjusting the effective length of said back strap.

12. A baby pouch as claimed in claim 9 wherein said complemental elements for detachably connecting said back straps to said receiving unit comprises:

(a) a metallic hook element carried on the depending end of each of said back straps; and (b) a metallic loop element carried on each of said lateral extensions which cooperate with said hook elements.

* * * * *

UNITED STATES PATENT OFFICE

CERTIFICATE OF CORRECTION

PATENT NO. : 4,149,687

DATED : April 17, 1979

INVENTOR(S) : Rosemary A. Nunemacher

It is certified that error appears in the above-identified patent and that said Letters Patent are hereby corrected as shown below:

On the title page, left hand column, the portion identifying the inventor which reads, "Ark." should read - - Arizona - -.

Signed and Sealed this

*Thirty-first* Day of *July 1979*

[SEAL]

*Attest:*

*Attesting Officer*

LUTRELLE F. PARKER

*Acting Commissioner of Patents and Trademarks*